US006009653A

United States Patent [19]

Harrington

[11] Patent Number: 6,009,653

[45] Date of Patent: Jan. 4, 2000

[54] BASEBALL BAT STYLED GRAPHIC MATERIAL DISPLAY DEVICE

[76] Inventor: Kirk D. Harrington, 631 Conestoga Trail, Chanhassen, Minn. 55317

[21] Appl. No.: 09/334,234

[22] Filed: Jun. 16, 1999

[51] Int. Cl.[7] ..... G09F 3/18

[52] U.S. Cl. ..... 40/660; 40/661; 40/586

[58] Field of Search ..... 40/660, 661, 586

[56] References Cited

U.S. PATENT DOCUMENTS 2,677,901 5/1954 Tilleman ..... 40/660 X 4,644,630 2/1987 Blum ..... 29/473

5,452,889 9/1995 Lewinski et al. ..... 473/519

5,487,203 1/1996 Brach, Jr. et al. ..... 40/586 X

*Primary Examiner*—Cassandra H. Davis

*Attorney, Agent, or Firm*—Roger W. Jensen

[57] ABSTRACT

A graphic material display device having a baseball bat-like shape. A centrally located shoulder and a second shoulder located adjacent one of the ends are connected by a web portion and support a transparent, hollow, cylindrical tube. Graphic material placed adjacent the web portion and within in the tube may be viewed through the tube. A sleeve selectively locks the tube in position or permits the tube to be removed to change the graphic material.

2 Claims, 3 Drawing Sheets

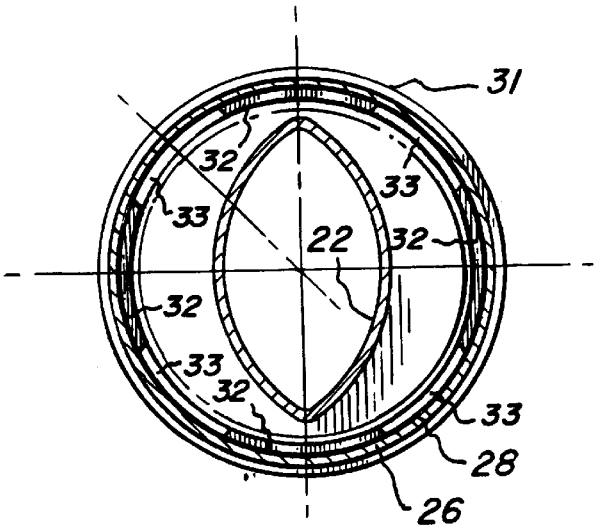
FIG. 5B
FIG. 4
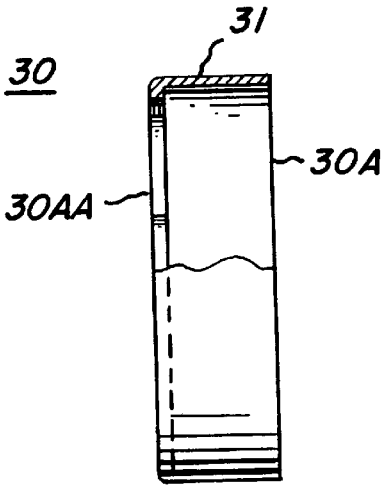
FIG. 5A
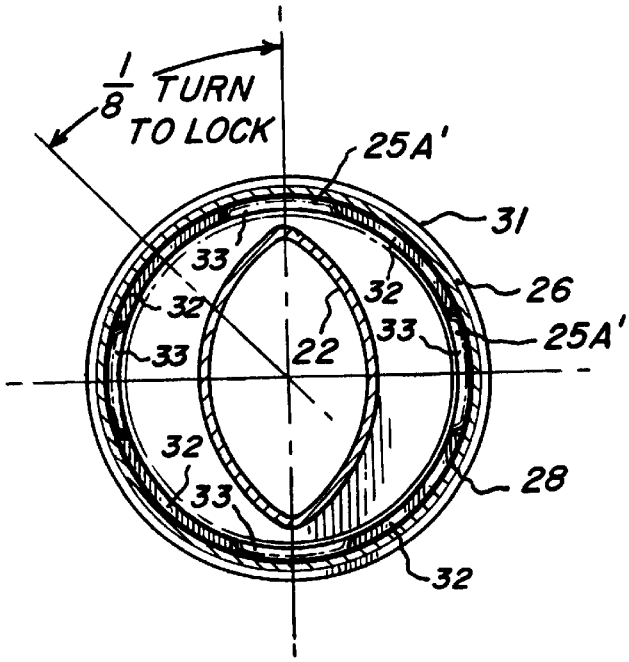

BASEBALL BAT STYLED GRAPHIC MATERIAL DISPLAY DEVICE

BACKGROUND OF THE INVENTION

The field of this invention is motivational display and is especially applicable for use with children, adolescents and young people.

Motivational displays take many forms such as posters, banners, clothing articles, and typically have some form of graphic for the motivational communication. One example in the field of athletics would be to have baseballs, basketballs, footballs, volleyballs and soccerballs (or replicas thereof) having a motivational display on the exterior surface thereof.

The present Applicant's prior patent, U.S. Pat. No. 5,890,308, titled "BASEBALL BAT STYLED GRAPHIC MATERIAL DISPLAY DEVICE" provides a motivational display of the aforementioned type. Briefly, it shows an elongated cylindrical member having a baseball bat like shape. A centrally located shoulder and a second shoulder located adjacent one of the ends of the member are connected by a web portion and support a transparent hollow cylindrical tube within which graphic material may be placed adjacent the web portion so that the same may be viewed through the tube. While the arrangement shown in U.S. Pat. No. 5,890,308 has been successful, the arrangement disclosed in said patent may prevent the removal of the transparent hollow cylindrical tube once it has been positioned on the elongated cylindrical member.

There are circumstances which make it desirable to change the graphic material from time to time and the present invention facilitates that usage of the display device.

SUMMARY OF THE INVENTION

The present invention provides an apparatus which has a baseball bat-like shape and comprising in part a hollow, transparent cylindrical tube within which may be placed graphic material. More specifically, the present invention comprises an elongated cylindrical member with a baseball bat-like handle at one end thereof, a centrally positioned shoulder, and a second shoulder located at the other end. A web portion connects the two shoulders and the transparent, hollow, cylindrical tube is assembled with, and mounted on the member extending between the shoulders, the overall assembled member and tube having a baseball bat-like shape. Graphic material is placed adjacent to the web portion and within the tube. The graphic material may be planar or three-dimensional. The present invention further includes means for selectively locking the cylindrical tube in position between the centrally positioned shoulder and the end shoulder of the elongated cylindrical member and, if desired, unlocking said cylindrical tube to permit the same to be disassembled and removed from the cylindrical member so as to facilitate, as desired, the changing of the graphic material.

BRIEF DESCRIPTION OF THE DRAWINGS

FIG. 4 is a side view, partly in section, of the sleeve 31 as viewed along section lines 4—4 of FIG. 3.

FIG. 5A is a view of the apparatus shown in FIG. 2 as viewed along section lines 5A—5A.

FIG. 5B is a view of the apparatus shown in FIG. 2 along section lines 5A—5A, except that the sleeve 31 has been turned relative to the other apparatus about its longitudinal axis one-eighth of a turn.

DETAILED DESCRIPTION OF THE INVENTION

Figure 1:
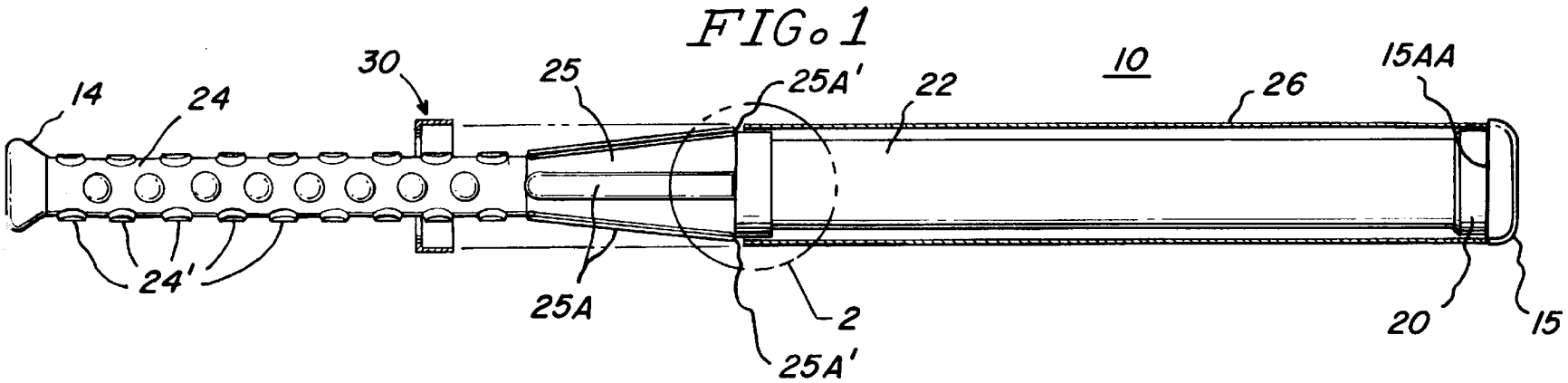
FIG. 1 shows a plan view of the preferred embodiment of my invention.
Figure 6:
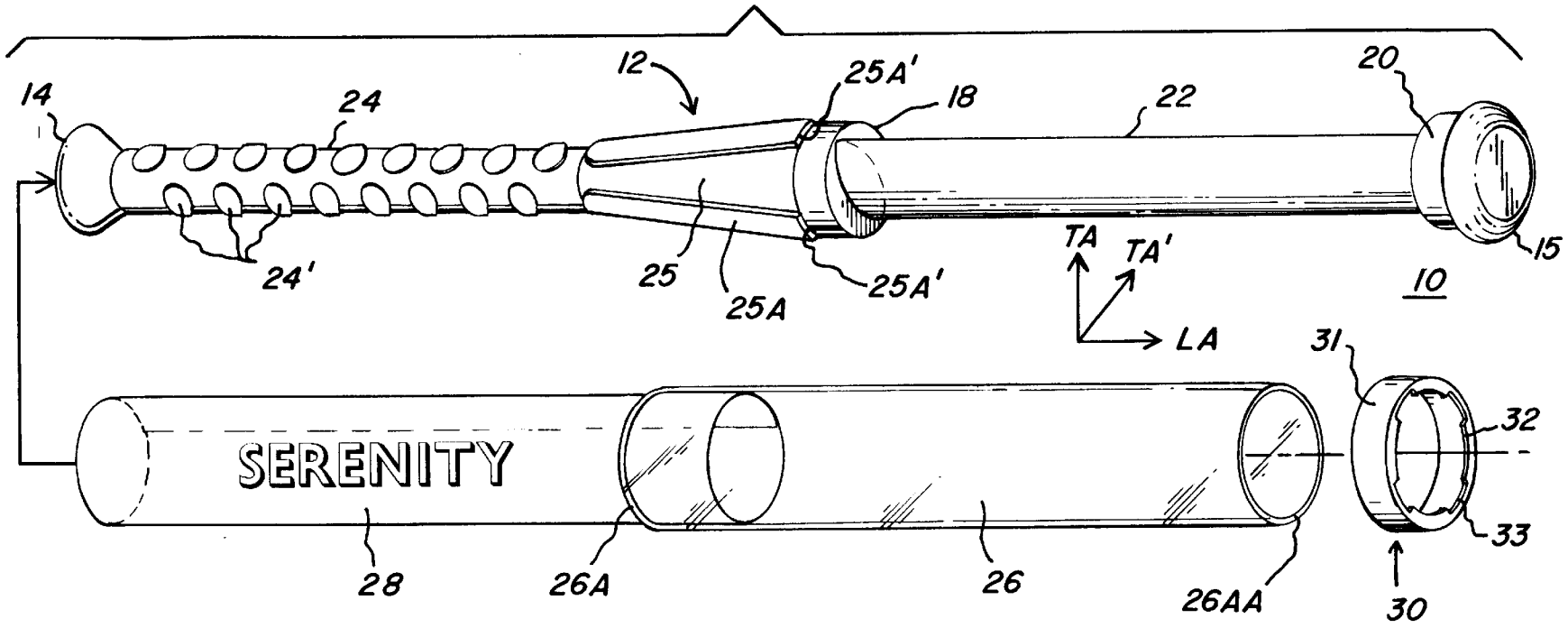
FIG. 6 shows an exploded isometric view of the preferred embodiment of my invention.

Referring to FIGS. 1 and 6, the reference numeral 10 designates the overall graphic material display device having a baseball bat-like shape and comprises an elongated cylindrical member 12 (FIG. 6) having a longitudinal axis LA and a pair of mutually perpendicular transverse axes TA and TA'. Member 12 has two ends, 14 and 15, a centrally located shoulder 18, and a second shoulder 20, located adjacent end 15. Shoulders 18 and 20 have a circular cross-section with the same diameter, which is preselected to snugly receive the inner diameter of the transparent, hollow tube 26, to be discussed below.

A web 22 is integrally connected between shoulders 18 and 20. In the preferred embodiment, the web 22 has a cross-section (see FIG. 5A) which is somewhat oval or football shaped, i.e., has a dimension along transverse axis TA which is greater than the dimension along transverse axis TA'. However, web 22 can have other cross-sections, such as circular, square or rectangular.

A baseball bat-like handle 24, also having a circular cross-section, is provided beginning at end 14 and extending toward the shoulder 18, up to a conically shaped or tapered portion 25 of member 12 intermediate the handle 24 and the shoulder 18 as is clearly shown in the drawings. More specifically, conically shaped portion 25 has a circular cross-section generally equal to that of handle 24 at its left end as depicted in FIGS. 1 and 6, and has a diameter substantially equal to the diameter of shoulder 18 at its right end as shown in FIGS. 1 and 6. Tapered portion 25 has a plurality of longitudinally and radially outwardly extending, spaced-apart ribs 25A disposed or arranged circumferentially around the tapered portion. The ribs 25A extend longitudinally to the right end of tapered portion 25 as is shown in FIGS. 1 and 6, and the terminations of said ribs define a plurality of circumferentially spaced-apart sector-like transverse abutments 25A' as is shown in FIG. 6.

A plurality of round raised portions 24' are positioned circumferentially and longitudinally on handle 24.

An elongated transparent, hollow, cylindrical tube having a circular cross-section is identified by reference numeral 26; it has two ends 26A and 26AA and an inner diameter preselected so that the tube may be slid into the position shown in FIG. 1 in the following manner. The handle 24, as shown, has a diameter substantially less than the diameter of the shoulders 18 and 20. Tube 26 is therefore slid onto the handle 24 and on into the position shown in FIG. 1 by end 26AA first sliding up the longitudinal sloped ribs 25A, and thence into engagement with end shoulder 20 as is shown in FIG. 1.

Graphic material 28 (see FIG. 6) is shown to be an elongated hollow cylindrical display on a suitable material such as paper or plastic, is adapted to be placed inside the transparent tube 26, whereby it may be viewed, prior to the placement of tube 26 to the position shown in FIG. 1.

While the graphic elements 28 and 29 as depicted are essentially planar, those skilled in the art will recognize that three-dimensional displays may also be used within the tube 26.

As indicated above, my invention provides a means for selectively locking the cylindrical tube 26 in positional contact with the shoulders 18 and 20 and, when desired, unlocking the tube 26 so as to permit same to be disassembled from the elongated cylindrical member 12.

The locking means includes the aforedescribed longitudinally and radially extending, spaced-apart ribs 25A, the terminations 25A' of which comprise a plurality of circumferentially spaced-apart sector-like transverse abutments.

Figure 3:
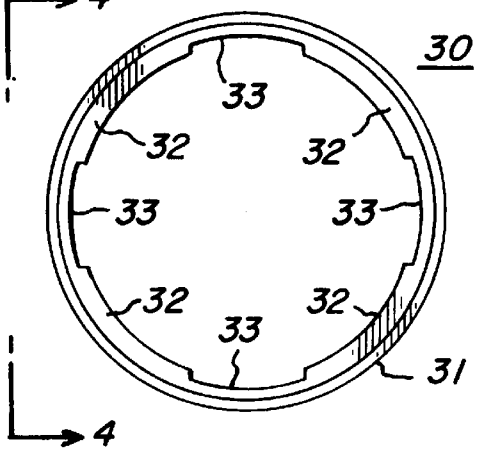
FIG. 3 is an end view of a sleeve 31 used to lock and unlock the hollow cylindrical tube 26.
Figure 2:
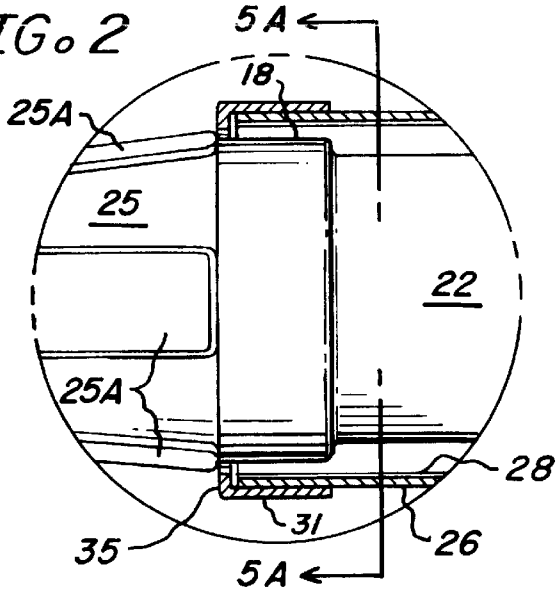
FIG. 2 shows an enlarged view of an encircled portion of the device of FIG. 1, showing the central shoulder 18, the transparent tube 26, and the locking sleeve 31.

The other member of the locking means is a sleeve member 31 shown in FIGS. 3 and 4, in particular, to be a relatively short (longitudinally) cylindrical sleeve having an inner diameter sized to receive the outer diameter of the tube 26, and further having two ends 30A and 30AA shown in FIG. 4. The sleeve is further characterized by having a shoulder on end 30AA thereof, extending radially inwardly to an inner castelated periphery shown best in FIG. 3, said periphery having a plurality of circumferentially spaced-apart sectors 32 (four sectors 32 are shown in FIG. 3), the number of sectors being equal in number to the number of plurality of ribs 25A on the tapered portion 25 of the handle. Further, the sectors 32 are sized so as to rotatably receive the outer diameter of the centrally located shoulder 18, i.e., once the sleeve is in the position as shown in FIG. 2, it will be understood that the sleeve may be rotated about its longitudinal axis relative to the member 12 which, of course, includes the ribs 25A and the shoulder 18.

Referring again to FIG. 3, it will be noted that the portions of the aforesaid castelated periphery between sectors 32 are identified by reference numeral 33, and these portions are sized to slidably receive the circumferential surfaces of ribs 25A. To further explain, when the locking sleeve 31 is assembled onto the display device after the transparent hollow tube 26 is first installed, the sectors 33 of the castelated periphery of the sleeve 31 are aligned with the ribs 25A and, as indicated, the dimensions are sized so that the sleeve 31 can be slid from the left end of ribs 25A, as shown in FIGS. 1 and 6, to the right, to the position depicted in FIGS. 1, 2, and 5A. Then, to achieve the locking function, the sleeve 31 is rotated one-eighth of a turn to the position depicted in FIG. 5B, at which point the sectors 32 on sleeve 31 are in engagement with and in register with the abutments 25A' at the extreme right end of ribs 25A as is depicted in FIGS. 1 and 6.

Thus, a relatively simple but very effective means is provided for locking the tube 26 in the position shown in FIG. 1. If it is desired at some later time to remove the tube 26, such as to change the graphic display material, then the sleeve 31 is merely rotated with respect to the member 12 to a position whereat the sectors 33 on the sleeve are in register with the ribs 25A, and then the entire sleeve 31 may be removed together with the tube 26.

While the preferred embodiment of the invention has been illustrated, it will be understood that variations may be made by those skilled in the art without departing from the inventive concept. Accordingly, the invention is to be limited only by the scope of the following claims.

I claim:

1. A graphic material display device comprising:

A) an elongated cylindrical member having a longitudinal and two mutually perpendicular transverse axes, two ends, a centrally located shoulder having an outer diameter positioned between said ends, a second shoulder located adjacent one of said ends, a web portion connecting said shoulders, and an elongated handle extending from the other of said ends a preselected distance toward said centrally located shoulder, said elongated handle having a tapered portion having first and second ends and positioned proximate to said centrally located shoulder, said tapered portion having:

i) a diameter substantially the same as the diameter of said centrally located should at said first end thereof;

ii) a reduced diameter at said second end thereof; and iii) a plurality of longitudinally and radially extending spaced-apart ribs disposed circumferentially around said tapered portion, said ribs extending longitudinally to and terminating at said first end thereof and said terminations of said ribs defining a plurality of circumferentially spaced-apart sector transverse abutments;

B) a transparent, hollow, cylindrical tube assembled with and removably mounted on said member and extending between said shoulders whereby graphic material placed within said tube may be viewed through said tube; and C) means for selectively:

i) locking said cylindrical tube in positional contact with said shoulders of said cylindrical member; and ii) unlocking said cylindrical tube to permit said cylindrical tube to be disassembled from said elongated cylindrical member.

2. Apparatus of claim 1 further characterized by said means for selectively locking and unlocking said cylindrical tube being a relatively longitudinally short cylindrical sleeve having:

A) an inner diameter sized to receive the outer diameter of said tube,

B) two ends; and

C) a shoulder on one of said ends of said short cylindrical sleeve thereof extending radially inwardly to an inner castelated periphery having a plurality of circumferentially spaced-apart sectors equal in number to the number of said plurality of ribs and sized to rotatably receive the outer diameter of said centrally located shoulder, portions of said periphery of said should of said short sleeve between said spaced-apart sectors of said short sleeve thereof being sized to slidably receive circumferential surfaces of said plurality of longitudinally extending spaced-apart ribs;

whereby said transparent cylindrical tube may be removably mounted on said member between said shoulders of said member to facilitate the viewing of graphic material placed within said tube, said tube being locked as aforesaid when said sectors of said shoulder of said sleeve are in register with said sector abutments of said ribs, and said tube being unlocked when said sleeve is longitudinally rotated so that said sectors of said shoulder of said sleeve are out of register with said ribs, thereby permitting removal of said tube from said member.

* * * * *